United States Patent [19]

Epple

[11] 4,176,261

[45] Nov. 27, 1979

[54] ELECTRIC SWITCH FOR MOTOR REVERSING

[75] Inventor: Peter C. Epple, Harper Woods, Mich.

[73] Assignee: General Motors Corporation, Detroit, Mich.

[21] Appl. No.: 916,105

[22] Filed: Jun. 16, 1978

[51] Int. Cl.[2] ..... H01H 9/00; HO1H 21/24

[52] U.S. Cl. ..... 200/1 V; 200/6 R; 200/6 B; 200/153 K

[58] Field of Search ..... 200/1 R, 1 V, 5 R, 6 R, 200/6 A, 6 B, 6 BA, 6 BB, 6 C, 17 R, 18, 153 K, 164 R, 335, 336, 33 O

[56] References Cited

U.S. PATENT DOCUMENTS

| | | | |
|---|---|---|---|
| 3,299,224 | 1/1967 | DeLorme et al. | 200/6 B |
| 3,299,241 | 1/1967 | Sayward | 200/153 K X |
| 3,479,478 | 11/1969 | Robbins | 200/6 R |
| 3,501,607 | 3/1970 | Tanaka | 200/6 BB X |

*Primary Examiner*—James R. Scott
*Attorney, Agent, or Firm*—Donald F. Scherer

[57] ABSTRACT

The drawings illustrate a double pole, double throw switch for use in selectively controlling energization of either a first or second electric circuit. The switch housing encompasses a pivotally mounted actuator button, two sets of first, second and third terminals mounted on a base member, and an insulator disc carrying two separate criss-crossing contact strips and pivotally mounted such that the strips normally contact respective first and third terminals of one set with one terminal contacting the second terminal of the other set. Oppositely disposed actuator elements are formed on the inner portion of the actuator button for contacting opposite edge portions of the pivotable base member. The actuator elements are moveable in response to initial movement of the actuator button in either direction so as to selectively cause one of the contact strips to pivot overcenter on the second and one of the first or third terminals into engagement with the other of the first or third terminals to provide a conductive path between respective first or third termimnals and thereby complete one of the first or second electric circuits.

2 Claims, 8 Drawing Figures

ELECTRIC SWITCH FOR MOTOR REVERSING

BACKGROUND OF THE INVENTION

This invention relates generally to electric switches and, more particularly, to double pole, double throw switches for use in selectively controlling energization of either a first or second electric circuit.

While various designs of double pole, double throw switches are currently in use and performing satisfactorily, they tend, generally, to be quite cumbersome and expensive. There is a need for an efficient, simplified switch of the double pole, double throw type for use in combination with permanent magnet motors in various vehicular applications, such as rear vent, door lock, seat back, and sunroof actuators.

Accordingly, a general object of the invention is to provide an improved double pole, double throw electric switch which includes the above-mentioned features.

Another object of the invention is to provide an electric switch which includes two sets of three terminals, with an insulator disc having two criss-crossing contact strips mounted thereon for pivotal movement with respect to the middle terminal of one set and one of the first or third terminals of the other set, in response to manual movement of an actuator button in one direction or the other, so as to bring one of the contact strips into engagement with the other of the first or third terminals to provide, with the other contact strip, a conductive path between respective first or third terminals and thereby complete one two electric circuits.

A further object of the invention is to provide a double pole, double throw electric switch for use in selectively controlling energization of either a first or second electric circuit, wherein the switch includes a housing having a base member and a cover member, and two rows of first, second and third terminals carried by the base member, with the conducting surface of one of the second terminals extending beyond the other terminals. An actuator button is pivotally mounted in the cover member, with oppositely disposed actuator elements formed thereon within the housing. A contact assembly includes an insulator disc adapted to being normally engaged at adjacent opposite edge portions thereof by the oppositely disposed actuator elements, first and second contact strips carried by the disc across opposite sides thereof in a criss-crossing pattern, and a spring element secured at one end thereof to the base member by the other of the second terminals so as to engage the first contact strip and normally urge the second contact strip into pivotal contact with the one of the second terminals and the first and second contact strips into contact with the first and third terminals adjacent the other of the second terminals. The disc is selectively pivotable about the one of the second terminals and either the first or third terminals adjacent the other of the second terminals by manual movement of the actuator button in one direction or the other so as to bring one of the first and second contact strips into engagement with the other of the first or third terminals to provide a conductive path between respective first or third terminals and thereby complete one of the first or second electric circuits.

BRIEF DESCRIPTION OF THE DRAWINGS

These and other objects and advantages of the invention will be apparent when reference is made to the following description and accompanying drawings, wherein.

DESCRIPTION OF THE PREFERRED EMBODIMENT

Figure 1:
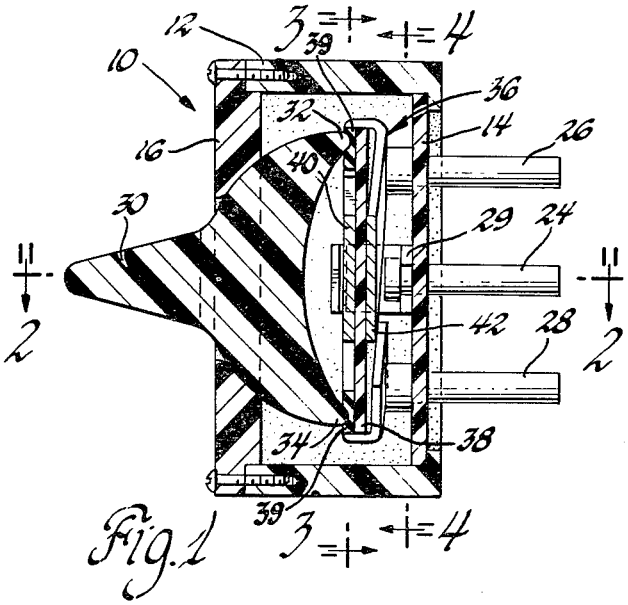
FIG. 1 is a cross-sectional view of an electric switch arrangement embodying the invention and illustrating a typical circuit therefore.
Figure 3:
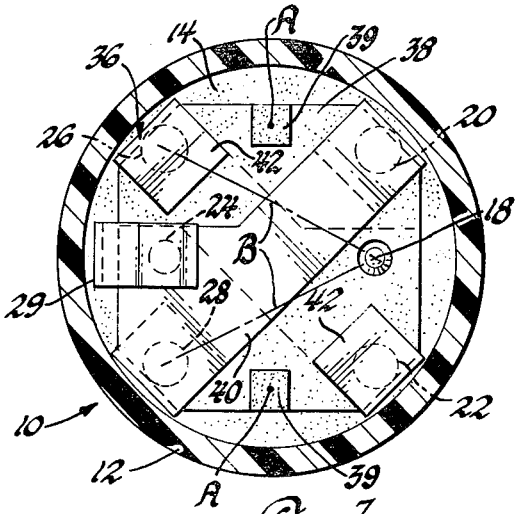
FIG. 3 is a cross-sectional view taken along the plane of the line 3—3 of FIG. 1, and looking in the direction of the arrows.
Figure 2:
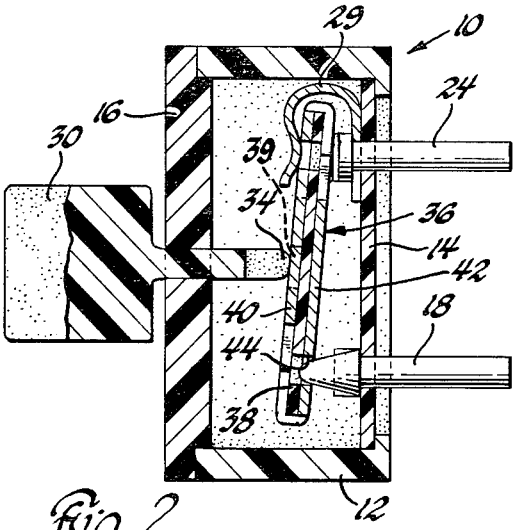
FIG. 2 is a cross-sectional view taken along the plane of the line 2—2 of FIG. 1, and looking in the direction of the arrows.
Figure 4:
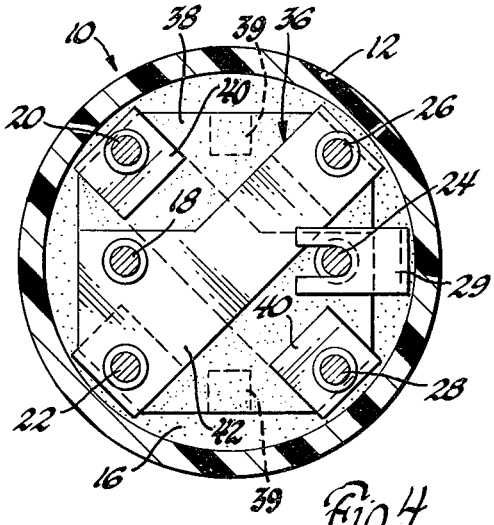
FIG. 4 is a cross-sectional view taken along the plane of the line 4—4 of FIG. 1, and looking in the direction of the arrows.

Referring now to the drawings in greater detail, FIGS. 1–4 illustrate a double pole, double throw electric switch 10 including a housing 12 having a base member 14 and a cover member 16, a first row of one load-connected and two battery-connected terminals 18, 20 and 22, respectively, and a second row of one load-connected and two grounded terminals 24, 26 and 28, respectively, carried by the base member 14, the terminals being spaced from each other and each having a conducting surface facing interiorly of the housing 12. The conducting surface of the load-connected terminal 18 is conical in shape and extends interiorly beyond the other terminals. The load-connected terminal 24 is shorter than all the other terminals and has its conducting surface on the opposite side from the others for cooperation with a spring element 29, as will be explained. The terminals 20, 22, 26 and 28 are all similar in structure, with slightly tapered conducting surfaces.

An actuator button 30 is pivotally mounted in the cover member 16, including oppositely disposed actuator elements 32 and 34 formed on the actuator button and extending interiorly of the housing 12. A contact assembly 36 includes an insulator disc 38 and a pair of resilient spacers 39 mounted adjacent oppositely disposed edges thereof. The resilient spacers 39 are adapted to being normally engaged by the oppositely disposed actuator elements 32 and 34, as shown in FIG. 1. Suitable resilient means, such as the spacers 39, are required to prevent a lock-up between the disc 38 and the actuator elements 32 and 34 as a result of the different vector lengths to the respective points of contact A (FIG. 3) from a line or pivot axis B between the terminal 18 and one or the other of the terminals 26 or 28, causing the respective edges of the disc to alternately move different amounts.

Top and bottom contact strips 40 and 42 are carried by the disc 38 across opposite sides thereof in a criss-crossing pattern with the ends of each contact strip folded onto the opposite side of the disc in a spaced relationship with the other contact strip. An opening or indentation 44 is formed in the second contact strip 42. The spring element 29 is clamped at one end thereof against the base member 14 by the load-connected terminal 24 and includes a U-shaped bend (FIG. 2) extending around the edge of the disc 38 so as to engage the top contact strip 40 and, thereby, normally retain the indentation 44 of the second contact strip 42 in engagement with the extended, conical, load-connected terminal 18 and the first and second contact strips 40 and 42 in engagement with the two grounded terminals 26 and 28 adjacent the opposite load-connected terminal 24.

Figure 5:
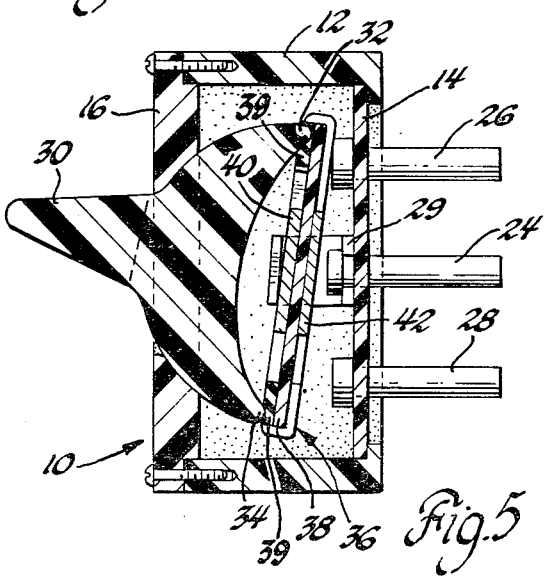
FIGS. 5 and 6 are views similar to FIG. 1 illustrating two different operational conditions.

The disc 38 is selectively pivotable about the conical terminal 18 and one or the other of the grounded terminals 26 and 28 adjacent the load-connected terminal 24 by manual movement of the actuator button 30 in one direction or the other (FIGS. 5 and 6) against one of the contact points A, so as to bring one of top or bottom contact strips 40 or 42 into engagement with a selected one of the battery-connected terminals 20 or 22 adjacent the load-connected terminal 18 and away from the respective grounded terminals 28 or 26. This provides a conductive path between respective opposite grounded and battery-connected terminals 26 and 20, or 28 and 22 thereby completing one of two possible electric circuits. For example, it may be noted in FIG. 7 that, under the operational condition of FIG. 5, with the contact strip 40 in contact with both the battery-connected terminal 20 and the center load-connected terminal 24 via the spring element 29, and the contact strip 42 in contact with both the load-connected terminal 18 and the grounded terminal 26, the circuit is complete from a battery 46 via a line 48 to the terminal 20 and thence through the contact strip 40 to the spring 29 and the terminal 24 and through a line 50 leading to a reversible permanent magnet motor 52. A line 54 is connected between the motor 52 and the other center load-connected terminal 18, and thence through the contact strip 42 to the terminal 26 and a line 56 leading to ground 58, completing the circuit.

Figure 6:
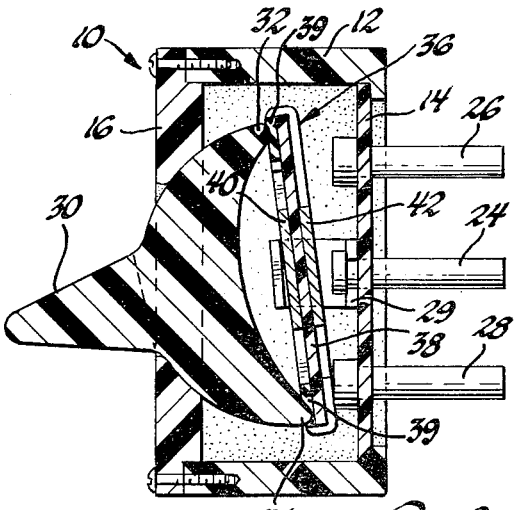
Figure 7:
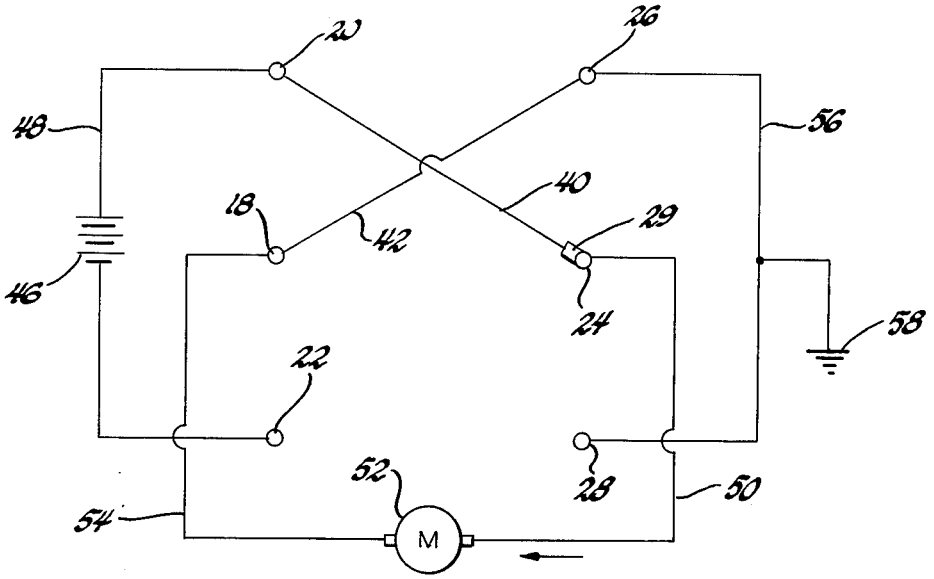
FIGS. 7 and 8 are circuit diagrams illustrating the two operational circuits resulting from the use of the inventive electric switch.
Figure 8:
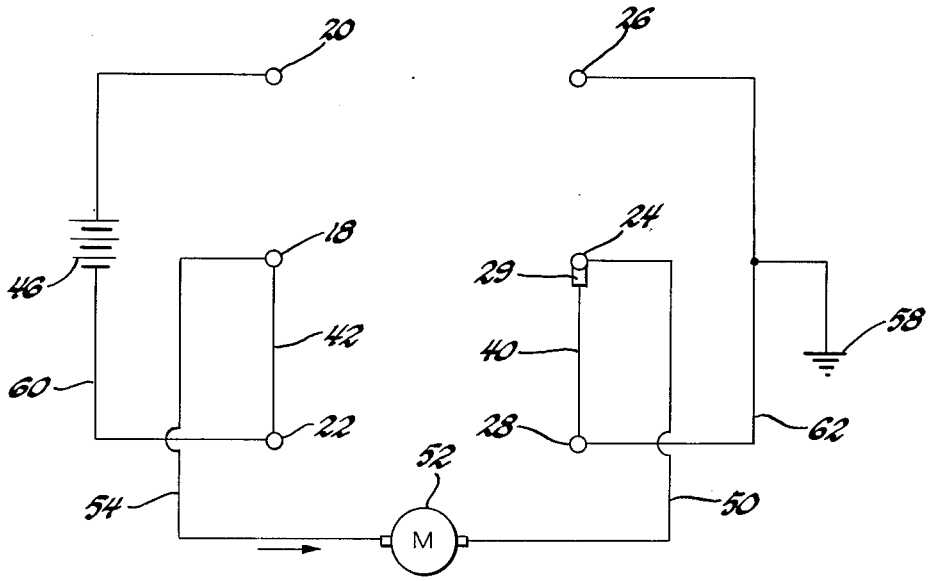

As shown in FIG. 8, under the operational condition of FIG. 6, with the contact strip 42 in contact with both the load-connected terminal 18 and the battery-connected terminal 22, and the contact strip 40 in contact with both the grounded terminal 28 and the load-connected terminal 24 via the spring 29, the circuit is complete via the battery 46, a line 60 to the terminal 22, the contact strip 42, the terminal 18, the line 54, the motor 52 (causing the latter to run in the opposite direction), the line 50, the other center terminal 24, the spring element 29, the contact strip 40, the terminal 28, and a line 62 to ground 58.

It should be apparent that the invention provides a compact and efficient double pole, double throw electric switch for selectively controlling energization of either a first or second electric circuit.

It should also be apparent that, in lieu of the resilient spacers 39 and the adjacent solid actuator elements 32 and 34, other resilient means, such as suitable spring fingers, or the like, could be secured to the actuator button 30 for resiliently contacting the oppositely disposed edge portions of the insulator disc 38. Alternatively, the actuator elements 32 and 34 could abut directly against an insulator disc 38 which is formed of suitable resilient material.

While but one embodiment of the invention has been shown and described, other modifications thereof are possible.

The embodiments of the invention in which an exclusive property or privilege is claimed are defined as follows:

1. An electric switch for use in selectively controlling energization of either a first or second electric circuit, said switch comprising a housing having a base member and a cover member, two rows of first, second and third terminals carried by said base member, said terminals being spaced from each other and each having a conducting surface facing interiorly of said housing with the conducting surface of one of said second terminals extending interiorly beyond the other terminals, an actuator button pivotally mounted in said cover member, oppositely disposed actuator elements formed on said actuator button and extending interiorly of said housing, a contact assembly including an insulator disc adapted to being normally engaged at adjacent opposite edge portions thereof by said oppositely disposed actuator elements, first and second contact strips carried by said disc across opposite sides thereof in a criss-crossing pattern with the ends of each contact strip folded onto the opposite side of said disc in a spaced relationship with the other contact strip, a spring element secured at one end thereof to said base member by the other of said second terminals so as to engage said first contact strip and normally urge said second contact strip into pivotal contact with said one of said second terminals and said first and second contact strips into contact with the first and third terminals adjacent said other of said second terminals, said disc being selectively pivotable about said one of said second terminals and either said first or third terminals adjacent the other of said second terminals by manual movement of said actuator button in one direction or the other so as to bring one of said first and second contact strips into engagement with the other of the first or third terminals to provide a conductive path between respective first or third terminals and thereby complete one of said first or second electric circuits.

2. An electric switch for use in selectively controlling energization of either a first or second electric circuit, said switch comprising a housing having a base member and a cover member, a first row of one load-connected and two battery-connected terminals and a second row of one load-connected and two grounded terminals carried by said base member, said terminals being spaced from each other and each having a conducting surface facing interiorly of said housing with the conducting surface of one of said load-connected terminals being conical in shape and extending interiorly beyond the other terminals, an actuator button pivotally mounted in said cover member, oppositely disposed actuator elements formed on said actuator button and extending interiorly of said housing, a contact assembly including an insulator disc adapted to being normally engaged at adjacent opposite edge portions thereof by said oppositely disposed actuator elements, first and second contact strips carried by said disc across opposite sides thereof in a criss-crossing pattern with the ends of each contact strip folded onto the opposite side of said disc in a spaced relationship with the other contact strip, an indentation formed in said second contact strip, a spring element secured at one end thereof to said base member by the other of said load-connected terminals so as to engage said first contact strip and normally urge said indentation of said second contact strip into pivotal contact with said conical terminal and said first and second contact strips into contact with said two grounded terminals adjacent said other of said load-connected terminals, said disc being selectively pivotable about said conical terminal and either of said grounded terminals adjacent the other of said load-connected terminals by manual movement of said actuator button in one direction or the other so as to bring one of said first and second contact strips into engagement with one of said battery-connected terminals adjacent said one of said load-connected terminals to provide a conductive path between respective ground-connected and battery-connected terminals and thereby complete one of said first or second electric circuits.

* * * * *